US005669158A

United States Patent [19]

Murray et al.

[11] Patent Number: 5,669,158

[45] Date of Patent: Sep. 23, 1997

[54] METHOD FOR COOLING A WEB

[75] Inventors: Robert R. Murray, Madbury; Stephen P. Fraczek, Lee; Dale H. Jackson, New Market, all of N.H.

[73] Assignee: Heidelberger Druckmaschinen AG, Heidelberg, Germany

[21] Appl. No.: 216,485

[22] Filed: Mar. 22, 1994

[51] Int. Cl.[6] ..... F26B 7/00

[52] U.S. Cl. ..... 34/393

[58] Field of Search ..... 34/336, 343, 380, 34/393, 419, 420, 421, 426, 430, 446, 449, 464, 470, 471

[56] References Cited

U.S. PATENT DOCUMENTS

| | | | |
|---|---|---|---|
| 2,115,630 | 4/1938 | Vao Gruber-Rehenburg et al. | 34/419 X |
| 2,157,385 | 4/1939 | Gessler et al. | 34/336 X |
| 2,157,388 | 5/1939 | MacArthur | 34/419 X |
| 2,197,823 | 4/1940 | Young | 34/446 |
| 2,804,693 | 9/1957 | Brodie | 34/422 |
| 3,623,235 | 11/1971 | Smith, Jr. | 34/420 X |
| 4,207,143 | 6/1980 | Glomb et al. | 34/449 X |
| 4,689,895 | 9/1987 | Taylor et al. | 34/114 X |
| 4,702,015 | 10/1987 | Taylor et al. | 34/428 |
| 4,763,424 | 8/1988 | Taylor et al. | 34/428 |
| 4,821,427 | 4/1989 | Chen | 34/446 |
| 4,872,270 | 10/1989 | Fronheiser et al. | 34/421 |
| 5,289,639 | 3/1994 | Bard et al. | 34/380 |
| 5,471,847 | 12/1995 | Murray et al. | 34/393 X |

*Primary Examiner*—John M. Sollecito
*Assistant Examiner*—Steve Gravini
*Attorney, Agent, or Firm*—Tarolli, Sundheim, Covell, Tummino & Szabo

[57] ABSTRACT

A method of removing heat from a moving web includes providing a quantity of a liquid which has a temperature of vaporization below the surface temperature of the web; heating the liquid to a temperature slightly below the temperature of vaporization of the liquid; spraying the heated liquid onto the surface of the web; and vaporizing liquid from the surface of the web to cool the web. In a preferred embodiment, an electrically charged screen is disposed intermediate the sprayer and the web. The liquid passes through openings in the screen to form electrically charged droplets of liquid which move onto the surface of the web. An apparatus for removing heat from a moving web includes liquid supply means for providing a liquid having a temperature of vaporization below the surface temperature of the web; heater means for heating the liquid to a temperature slightly below its temperature of vaporization; and sprayer means for spraying the heated liquid onto the surface of the web.

12 Claims, 2 Drawing Sheets

METHOD FOR COOLING A WEB

BACKGROUND OF THE INVENTION

1. Technical Field

The present invention relates to a method and apparatus for cooling a web. In particular, the present invention relates to a method and apparatus for cooling a moving web of paper in a printing system.

2. Description of the Prior Art

U.S. Pat. Nos. 4,689,895, 4,702,015, and 4,763,424 disclose apparatus and methods for cooling a moving web of paper by spraying water in the form of a fog onto the web. The water has a temperature lower than the temperature of the surface of the web. The water draws heat from the web and evaporates, thereby cooling the web.

SUMMARY OF THE INVENTION

The present invention is a method of removing heat from a moving web. The method comprises the steps of providing a quantity of a liquid which has a temperature of vaporization below the surface temperature of the web; heating the liquid to a temperature slightly below the temperature of vaporization of the liquid; spraying the heated liquid onto the surface of the web; and vaporizing liquid from the surface of the web to cool the web. In a preferred embodiment, an electrically charged screen is disposed intermediate the sprayer and the web. The liquid passes through openings in the screen to form electrically charged droplets of liquid which are deposited on the surface of the web.

The present invention is also an apparatus for removing heat from a moving web. The apparatus comprises liquid supply means for providing a liquid having a temperature of vaporization below the surface temperature of the web; heater means for heating the liquid to a temperature slightly below its temperature of vaporization; and sprayer means for spraying the heated liquid onto the surface of the web. The liquid vaporizes upon contact with the surface of the web to cool the web. In a preferred embodiment, an electrically charged screen is disposed intermediate the sprayer means and the web. The screen has a plurality of openings extending through the screen for forming electrically charged droplets of liquid moving toward the surface of the web.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF PREFERRED EMBODIMENTS OF THE INVENTION

Figure 1:
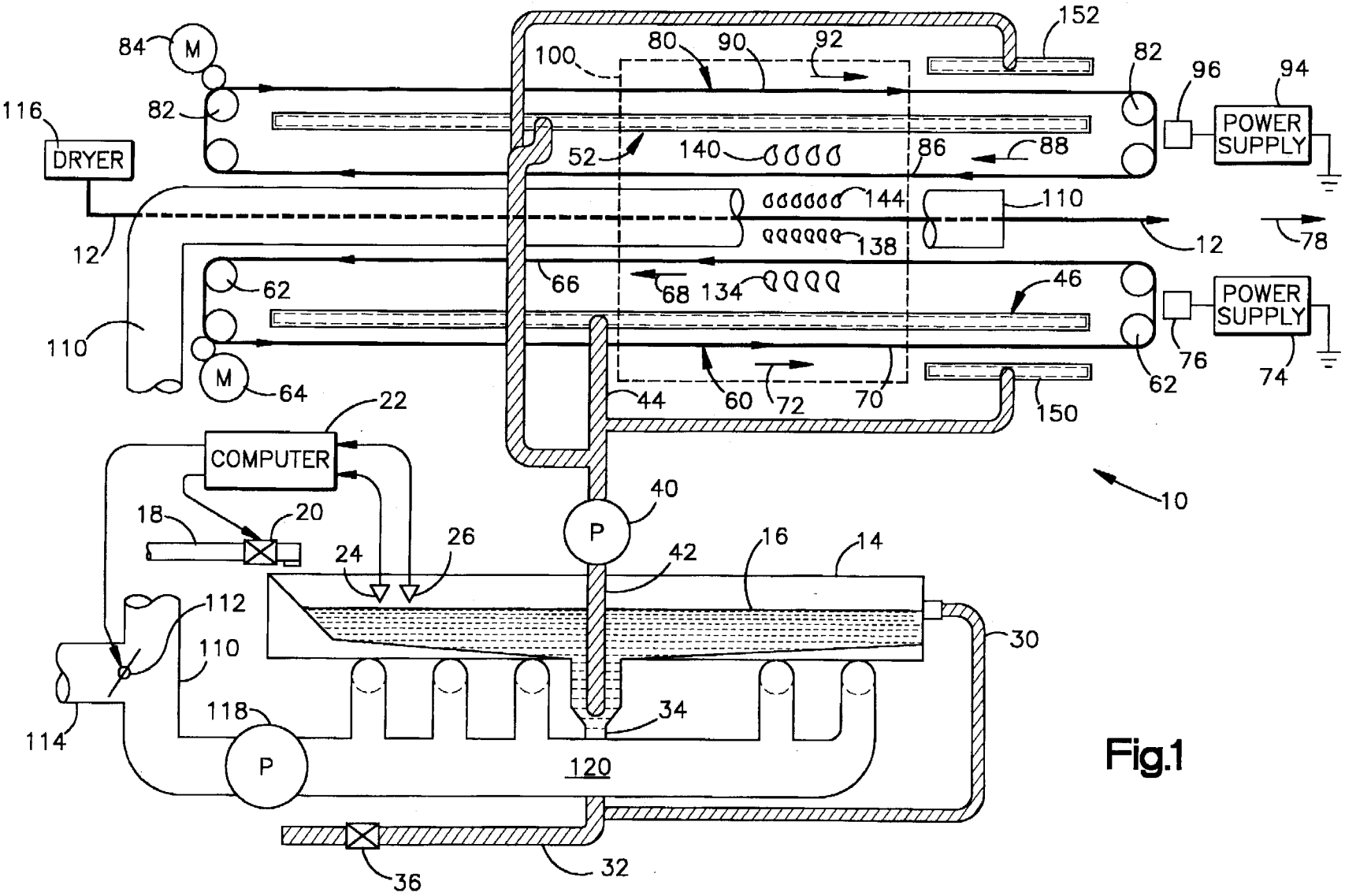
FIG. 1 is a schematic illustration of a web cooling system in accordance with the present invention.

The present invention relates to a method and apparatus for cooling a web. In particular, the present invention relates to a method and apparatus for cooling a moving web of paper in a printing system. The present invention is applicable to various web cooling system constructions. As representative of the present invention, FIG. 1 illustrates schematically a web cooling system 10 for cooling a web 12.

The web cooling system 10 includes a sump 14 containing a quantity of liquid 16. The liquid 16 is preferably water. Water is supplied to the sump 14 by a supply line 18 having an electrically controlled inlet valve 20. Operation of the inlet valve 20 between its open and closed positions is controlled by a computer 22.

The computer 22 receives signals from a water level sensor 24 and from a water temperature sensor 26. The water level sensor 24 senses the level of water in the sump 14. The water temperature sensor 26 senses the temperature of the water in the sump 14.

A surface water skimmer line 30 is operative to draw water off the surface of the body of water 16 in the sump 14. The skimmer line 30 is connected in fluid communication with a discharge line 32. A sump drain line 34 is also connected in fluid communication with the discharge line 32. The sump drain line 34 is operative to drain water from the bottom of the body of water 16 in the sump 14. A drain valve 36 in the discharge line 32 controls the drainage through the drain line 34 and the skimmer line 30.

A water pump 40 is operative to draw water from the sump 14 through an inlet line 42. The water pump 40 delivers water under pressure through a first water supply line 44 to a first spray manifold 46. The spray manifold 46 has a plurality of first spray heads 48 (FIG. 2) for discharging water from the first spray manifold. The pump 40 also supplies water through a second water supply line 50 to a second spray manifold 52. The second spray manifold 52 has a plurality of second spray heads 54 for discharging water from the second spray manifold.

Figure 2:
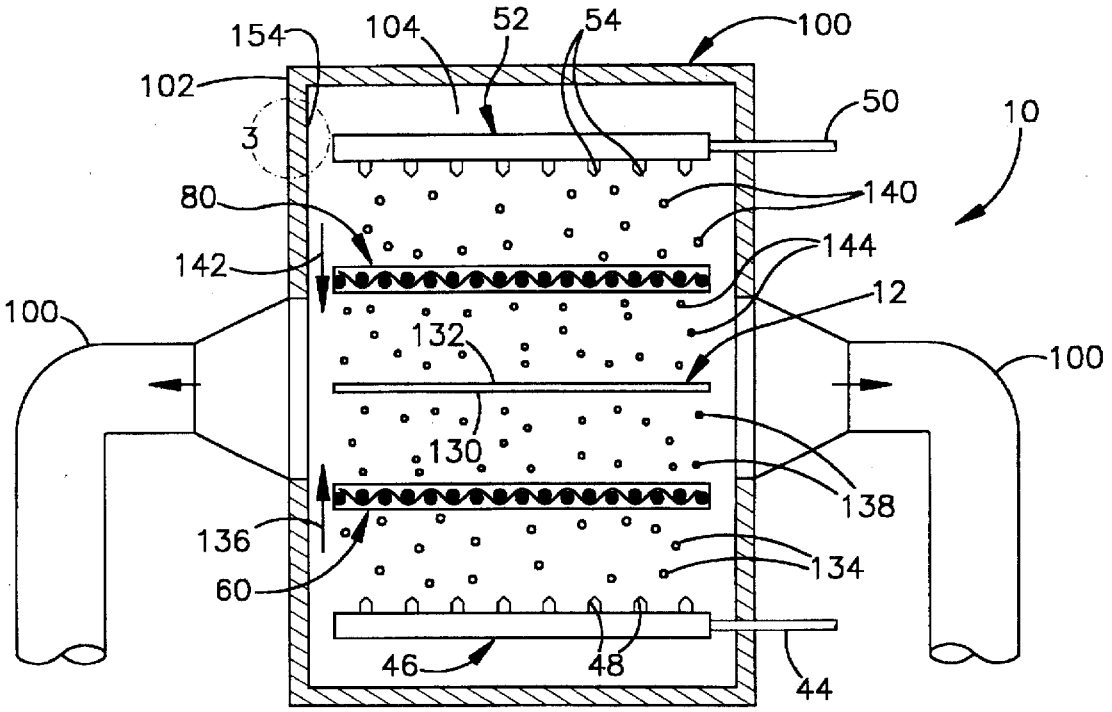
FIG. 2 is a schematic sectional view through a sprayer box portion of the web cooling system of FIG. 1.

A first screen 60 is disposed intermediate the first spray manifold 46 and the web 12. The first screen 60, as indicated schematically in FIG. 2, is approximately the same width as both the web 12 and the first spray manifold 46. The first screen 60 is illustrated schematically in FIG. 2 as being a woven wire mesh screen. It should be understood that the first screen 60 could be any type of screen having the desired size openings for passing liquid therethrough.

The first screen 60 is trained about a plurality of rollers 62. A drive assembly 64 drives the first screen 60 for movement in a continuous path about the rollers 62. As the screen 60 moves, a first portion 66 of the screen 60 passes between the first spray manifold 46 and the web 12 in a direction indicated by the arrow 68. The direction 68 is opposite to the direction of movement 78 of the web 12. A second portion 70 of the first screen 60, not disposed between the first spray manifold 46 and the web 12, moves in a direction 72 opposite to the direction 68.

The first screen 60 is preferably made of an electrically conductive material such as metal. The first screen 60 is electrically charged by a power supply 74 through a contact 76 engaging the moving screen 60. Preferably, the power supply 74 places a positive electrical charge on the first screen 60.

A second screen 80, identical in construction to the first screen 60, is associated with the second spray manifold 52. The second screen 80 is driven in a continuous path about a plurality of rollers 82 by a drive assembly 84. The second screen 80, as it moves, has a first portion 86 disposed intermediate the second spray manifold 52 and the moving web 12. The first portion 86 of the second screen 80 moves in a direction of movement 88 opposite to the direction of movement 78 of the web 12. An opposite portion 90 of the second screen 80, not disposed between the second spray manifold 52 and the web 12, moves in a direction 92 opposite to the direction 88.

The second screen 80 is preferably made of an electrically conductive material such as metal. The second screen 90 is electrically charged by a power supply 94 through a contact 96 engaging the moving second screen. Preferably, a positive electrical charge is placed on the second screen 80.

The web 12, as it moves through the cooling system 10, passes through a sprayer box 100 (FIGS. 1 and 2). The sprayer box 100 has a wall 102 defining a spray chamber 104 through which the web 12 moves. The first spray manifold 48 and the second spray manifold 52 are disposed in the spray chamber 104. The first and second screens 60 and 80 also move through the sprayer box 100.

A steam conduit 110 is connected with the sprayer box 100 for exhausting steam from the spray chamber 104. A steam control valve 112 controls fluid flow through the steam conduit 110. When the control valve 112 is in a first position, steam from the conduit 110 is exhausted through a steam exhaust line 114 to be incinerated in a known dryer 116 through which the moving web 12 passes upstream of the sprayer box 100. When the steam control valve 112 is in a second position, steam through the steam conduit 110 is directed to a steam pump 118. The steam pump 118 pumps steam under pressure into a steam manifold 120. Steam from the manifold 120 is sent into the sump 14.

In operation of the web cooling system 10, the moving web 12 passes from the dryer 116 into the spray chamber 104 in the sprayer box 100. The web 12 passes between the first and second spray manifolds 46 and 52. The first screen 60 is disposed intermediate the first spray manifold 46 and a first major side surface 130 (FIG. 2) of the web 12. The second screen 80 is disposed intermediate the second spray manifold 52 and a second major side surface 132 of the web 12.

As the web 12 moves through the sprayer box 100, the water pump 40 draws water from the sump 14 through the inlet 42. The water pump 40 directs water under pressure into the first spray manifold 46. Water sprays out of the first sprayer heads 48 on the first spray manifold 46 in the form of water droplets 134.

The droplets 134 move in a direction 136 toward the first major side surface 130 of the web 12. The water droplets 134 contact the first screen 60. The water passes through and emerges from the openings in the first screen 60 in the form of water droplets indicated schematically at 138. The droplets 138 contact the first major side surface 130 of the moving web 12.

Simultaneously, the water pump 40 directs water under pressure from the sump 14 into the second spray manifold 52. Water is sprayed out of the second sprayer heads 54 of the second spray manifold 52 in the form of water droplets 140. The water droplets 140 move in a direction indicated by the arrow 142 toward the second major side surface 132 of the web 12.

The water droplets 140 contact the second screen 80. The water which passes through the openings in the second screen 80 emerges as water droplets 144. The water droplets 144 move into contact with the second major side surface 132 of the moving web 12.

The web 12 typically has a surface temperature of about 300° F. (149° C.). The water droplets 138 and 144 are at a temperature lower than the surface temperature of the moving web 12. The water droplets which are deposited on the web 12 absorb sufficient heat from the web to vaporize. As the water vaporizes, it carries heat away from the web 12, cooling the web. The vaporized water, or steam, is exhausted through the steam conduit 100, which is maintained in a known manner at a pressure slightly below the pressure in the spray chamber 104.

In order to draw the maximum amount of heat from the web 12 in the shortest period of time, the water is heated to just below its vaporization temperature of 212° F. before being sprayed on the moving web. Thus, the water which is deposited on the web 12 draws a very large amount of heat from the web in a short period of time. This is because the heat of vaporization of water, which is the amount of heat needed to change water from its liquid state to its gaseous state, is so large compared to the amount of heat needed to simply raise the temperature of liquid water. Thus, it is more efficient to draw heat out of the web 12 by spraying very hot water which vaporizes almost immediately than by heating the water first while it is on the web and then vaporizing it.

Accordingly, providing water droplets 138 and 144 at a temperature just below their temperature of vaporization increases the amount of heat drawn from the web which goes into vaporization as compared to the amount of heat which goes into heating the water first. This increases the efficiency of the process of cooling the web 12. Further, the tendency of water to collect on the web is minimized by rapid vaporization of the cooling liquid sprayed onto the web. The residence time of the water droplets on the web 12 is minimized because the water vaporizes almost immediately.

The temperature of the water 16 in the sump 14 is controlled so that the water droplets 138 and 144, which contact the web 12, are at a temperature just slightly below the temperature of vaporization of water, 212° F. (100° C.). The temperature sensor 26 (FIG. 1) senses the temperature of the water 16 in the sump 14. If the temperature of the water in the sump 14 is more than slightly below about 212° F. (100° C.), the computer 22 actuates the steam control valve 112 to a position in which some or all of the steam flowing through the steam conduit 110 is directed into the steam manifold 120.

Steam from the steam manifold 120 flows into the body of water 16 in the sump 14. The steam flowing through the steam manifold 120 into the sump 14 is at a temperature above 212° F. Thus, the steam heats the water 16 in the sump 14. The temperature sensor 26 and the computer 22 cooperate to control the steam control valve 112 to direct an appropriate amount of steam through the manifold 120 into the sump 14, sufficient to maintain the temperature of the water 16 just below its temperature of vaporization of 212° F.

The computer 22 also cooperates with the temperature sensor 26 to supply cool water through the supply line 18 to the sump 14, as needed to prevent boiling of the water 16. The computer 22 and the water level sensor 24 also cooperate to supply make-up water through the inlet supply line 18, to maintain the proper water level in the sump 14.

If a liquid other than water is used, then such other liquid is sprayed at a temperature just below its temperature of vaporization.

The screens 60 and 80, which are disposed between the spray manifolds 46 and 52 and the web 12, serve several functions. The screens 60 and 80 are charged with a positive electrical charge. Therefore, the water passing through the screens 60 and 80 assumes a positive electrical charge. The moving web 12 typically has a negative electrical charge prior to entry into the spray chamber 104. This negative charge arises as the web 12 passes through ambient air, between the rolls of the printing apparatus with which the cooling system 10 is associated, and as the web has high speed hot air blown over it in the dryer 116. Because of these opposite electrical charges, the positively-charged water droplets 138 and 144 adhere more tightly to the negatively-charged web 12. This increases the efficiency of the heat transfer from the web 12 to the water deposited on the web.

The positively-charged water droplets 138 and 144 on the web 12 also counteract or neutralize the negative electrical charge on the web. This reduces the tendency of the material of the web 12 to stick to itself, either in roll form or as cut up into sheet form.

The screens 60 and 80 also control the size of the water droplets 138 and 144 which contact the web 12. Water droplets 138 and 144 which are too small will not absorb an optimum amount of heat from the web 12, while water droplets which are too large remain on the web 12 for a longer period of time than desired. Accordingly, by providing appropriately-sized openings in the screens 60 and 80, water droplets 138 and 144 of an optimum size can be directed onto the web 12. The size of the openings in the screens 60 and 80 is selected dependent upon the temperature of the moving web, the desired residence time for the water droplets on the web, and the amount of heat to be transferred, among other factors.

The screens 60 and 80 also clean impurities from the water which is sprayed onto the web 12 from the spray manifolds 46 and 52. The water droplets 134 and 140 from the spray manifolds 46 and 52 are larger than the size of the openings in the second screen 80. As the water droplets pass through the openings in the screens 60 and 80, they are reduced in size to form the smaller water droplets 138 and 144. As the water passes through the screens 60 and 80, impurities in the water remain on the screens rather than being transferred to the web 12.

The screen 60, as it travels about the rollers 62, passes through a screen cleaner indicated schematically at 150 (FIG. 1). The screen cleaner 150 is preferably a sprayer apparatus which sprays heated high-pressure water against the screen 60. Impurities on the screen 60 are removed by the pressurized hot water spray from the screen cleaner 150. A similar screen cleaner 152 is provided for the second screen 80. Thus, the screens 60 and 80 are continuously cleaned before moving back into position between the spray manifolds 46 and 52 and the web 12.

Impurities in the water supply are also removed at the sump 14. When the inlet supply valve 20 is opened to supply make-up water to the sump 14, the computer 22 simultaneously causes the drain valve 36 to be opened. A small amount of water from the surface of the body of water 16 in the sump 14 is drawn through the skimmer line 30 into the discharge line 32. Impurities which tend to collect on the surface of the body of water 16 are removed through the skimmer line 30. Also, a small amount of water from the sump drain line 34, at the bottom of the sump 14, is simultaneously drawn from the sump. This removes impurities which might collect at the bottom of the body of liquid 16 in the sump 14.

Water drained through the discharge line 32 and the drain valve 36 is delivered to the burner of the dryer 116 to be incinerated. Also, the excess steam from the steam conduit 110 is delivered through the steam exhaust line 114 to the burner of the dryer 116 to be incinerated. Thus, pollution from the cooling system 10 is minimized since gasses and liquid leaving the otherwise closed cooling system 10 are incinerated in the burner of the dryer 116.

Figure 3:
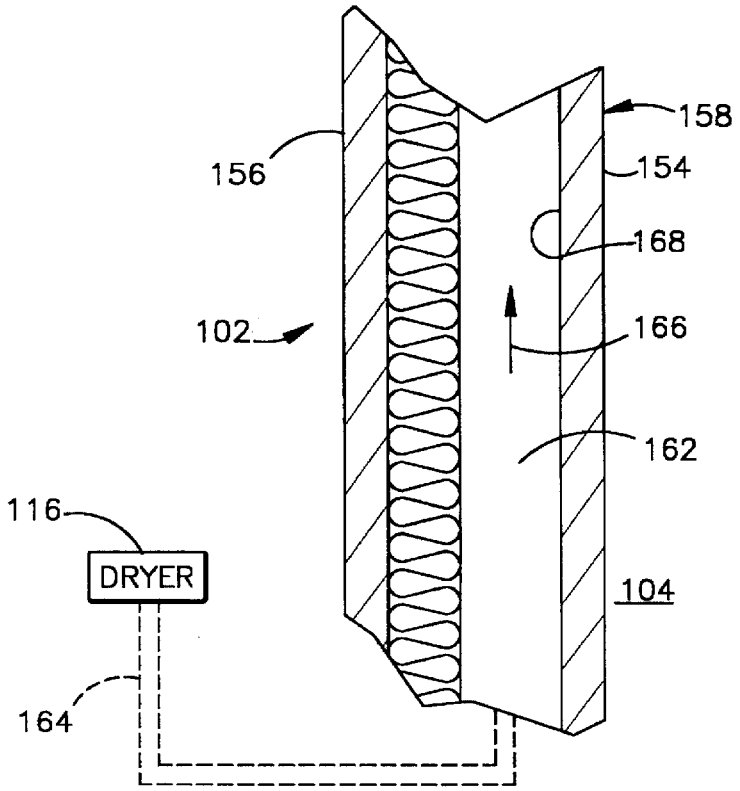
FIG. 3 is a schematic sectional view through a wall of the sprayer box of FIG. 2.

The wall 102 of the sprayer box 100 (FIGS. 2 and 3) is heated to minimize condensation on the inner surface 154 of the sprayer box wall. The sprayer box wall 102 (FIG. 3) is preferably a multi-layer construction including a metal outer panel 156, a metal inner panel 158, and a layer of insulation 160 disposed between the panels 156 and 158. An air passage 162 separates the insulation layer 160 from the inner panel 158. The sprayer box wall inner surface 154, which is exposed to the interior of the spray chamber 104, is on the opposite side of the inner panel 158 from the passage 162.

Hot air, preferably from the dryer 116, is directed through a passage 154 into the hot air passage 162 in the wall 102. The hot air moves through the wall 102 in a direction indicated by the arrow 166. The hot air moving through the passage 162 contacts an inner surface 168 of the panel inner panel 158. Heat is transferred from the hot air in the passage 162 to the inner panel 158. This raises the temperature of the wall surface 154 adjoining the spray chamber 104. Because the wall surface 154 is heated, there is less tendency for moisture in the spray chamber 104 to condense on the wall surface. This reduces the amount of impurities collected on the wall 102 of the spray chamber 100.

The web 12 is the primary heat source for the heated liquid used in the cooling system 10. The web 12 is at a temperature above the temperature of vaporization of water. The web 12 heats the water droplets 138 and 144 sprayed onto the web and turns them into steam. As this steam passes through the body of liquid 16 in the sump 14, the steam turns back into water while it simultaneously heats the water.

It should be understood that the cooling system 10 is usable in conjunction with a web 12 which moves either vertically or horizontally. If the web 12 is moving horizontally, then the major side surfaces 130 and 132 of the web are the upper and lower side surfaces of the web. If the web 12 is moving vertically, the major side surfaces of the web extend vertically, and the spray manifolds 46 and 52 spray liquid horizontally toward the web surfaces.

From the above description of the invention, those skilled in the art will perceive improvements, changes and modifications in the invention. Such improvements, changes and modifications within the skill of the art are intended to be covered by the appended claims.

We claim:

1. A method of removing heat from a moving web having a surface temperature, said method comprising the steps of:

providing a body of liquid which has a temperature of vaporization below the surface temperature of the web;

heating the body of liquid to a temperature slightly below its temperature of vaporization;

spraying the heated liquid in a first direction onto the surface of the web; and vaporizing liquid from the surface of the web to cool the web.

2. A method as set forth in claim 1 wherein said step of heating the body of liquid to a temperature slightly below its temperature of vaporization comprises the step of heating water to a temperature slightly below about 212° F.

3. A method as set forth in claim 1 wherein said step of heating the body of liquid includes the steps of capturing vaporized liquid from the web and directing the captured vaporized liquid into the body of liquid to transfer the heat content of the vaporized liquid into the body of liquid.

4. A method as set forth in claim 3 wherein said step of heating the body of liquid comprises the steps of sensing the temperature of the body of liquid and controlling the amount of vaporized liquid directed into the body of liquid in response to the sensed temperature in order to prevent boiling of the body of liquid.

5. A method as set forth in claim 1 wherein said step of spraying the heated liquid onto the web includes the step of spraying the heated liquid through openings in a screen to form droplets of liquid moving in the first direction toward the surface of the web.

6. A method as set forth in claim 5 comprising the step of maintaining on the screen an electric charge opposite to an electric charge on the web surface while performing the step of spraying the liquid through the openings in the screen.

7. A method as set forth in claim 5 comprising the step of moving one portion of the screen through a screen cleaner while spraying the heated liquid through openings in another portion of the screen.

8. A method as set forth in claim 1 including the step of moving the web in a generally horizontal direction, said step of spraying the heated liquid onto the surface of the web comprising spraying the heated liquid onto opposite upper and lower surfaces of the web.

9. A method as set forth in claim 1 including the step of moving the web in a generally vertical direction, said step of spraying the heated liquid onto the surface of the web comprising spraying the heated liquid onto opposite vertically extending surfaces of the web.

10. A method as set forth in claim 1 wherein said step of providing a body of liquid comprises the steps of:

containing the body of liquid in a sump; and minimizing contamination of the body of liquid in the sump by periodically removing a surface portion of the body of liquid and by draining a lower portion of the body of liquid from the sump.

11. A method as set forth in claim 1 wherein said steps of spraying the liquid and vaporizing the liquid are performed in a spray chamber having a wall with an outer surface and with an inner surface presented toward the web, said method including the step of heating the wall to minimize condensation from the spray chamber on the inner surface of the wall.

12. A method as set forth in claim 11 wherein said step of heating the wall comprises directing hot air from a web dryer against the outer surface of the wall to transfer heat from the web dryer hot air to the wall.

* * * * *